United States Patent [19]

Dimitraki et al.

[11] 4,372,497

[45] Feb. 8, 1983

[54] METHOD OF MANUFACTURING WOUND ITEMS FROM COAXIAL MICROWIRE AND DEVICE THEREFOR

[76] Inventors: Sergei N. Dimitraki; Lolita S. Dimitraki, both of ulitsa Bubnovskogo, 5/5, kv. 118, Kishinev, U.S.S.R.

[21] Appl. No.: 205,445

[22] PCT Filed: Jan. 8, 1980

[86] PCT No.: PCT/SU80/00001

§ 371 Date: Sep. 8, 1980

§ 102(e) Date: Sep. 3, 1980

[87] PCT Pub. No.: WO80/01431

PCT Pub. Date: Jul. 10, 1980

[30] Foreign Application Priority Data

Jan. 8, 1979 [SU] U.S.S.R. ..... 2700551
Jan. 8, 1979 [SU] U.S.S.R. ..... 2700552

[51] Int. Cl.[3] ..... H01F 41/04; H01C 17/22

[52] U.S. Cl. ..... 242/7.03; 29/593; 29/605; 29/618; 242/7.12; 324/62

[58] Field of Search ..... 242/7.03, 7.12; 29/593, 29/605, 618; 324/62

[56] References Cited

U.S. PATENT DOCUMENTS 2,725,199 11/1955 Bower ..... 242/7.12

FOREIGN PATENT DOCUMENTS 174722 10/1965 U.S.S.R. .
222555 7/1968 U.S.S.R. ..... 242/7.12
246640 11/1969 U.S.S.R. .
274186 11/1970 U.S.S.R. .
388305 11/1973 U.S.S.R. .
408380 12/1973 U.S.S.R. ..... 242/7.12
493809 11/1975 U.S.S.R. .
588508 1/1978 U.S.S.R. ..... 324/62

OTHER PUBLICATIONS

"Microwire and Resistance Devices", No. IV, 1969, I. I. Grishanov et al.

"Fundamentals of Phase Metering", O. O. Galakhova, et al., Energiya Publishers, Leningrad, 1976, pp. 140–143.

*Primary Examiner*—Billy S. Taylor
*Attorney, Agent, or Firm*—Lilling & Greenspan

[57] ABSTRACT

A method of manufacturing wound items from coaxial microwire by the use of a device executing said method, which essentially consists in determining frequency $f_1$ of a generator at which a phase shift between current vector in a sheath and voltage vector between the sheath and conductor of a microwire of the item being manufactured equals 180° when the item being manufactured has a parameter exceeding a corresponding rating. When the parameter of the item fully complies with the corresponding rating, frequency $f_2$ of a second generator is set so that a phase shift between the current vector in the sheath and the voltage vector between the sheath and the conductor of the microwire is 180°. A frequency changer is then used to convert voltages at $f_1$ and $f_2$ into a voltage at $f_X$ which is fed to the sheath of the item. A drive is utilized to unwind the microwire, while an amplifier and converter unit continuously compares a current vector phase in the sheath of the unwound microwire with a voltage vector phase between the conductor and the sheath of said microwire. The unwinding of the microwire is stopped after said phase difference reaches 180°.

4 Claims, 3 Drawing Figures

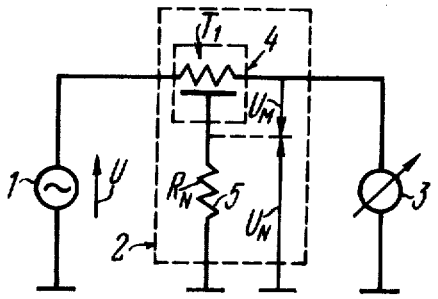
FIG.1
FIG.2
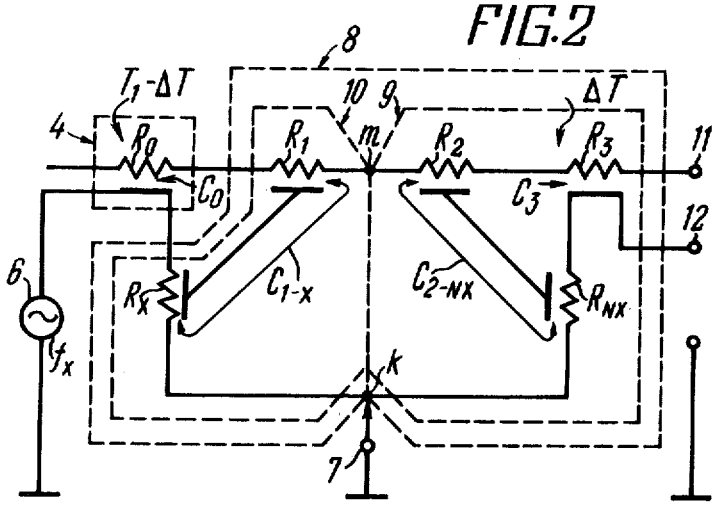

METHOD OF MANUFACTURING WOUND ITEMS FROM COAXIAL MICROWIRE AND DEVICE THEREFOR

FIELD OF THE INVENTION

The invention relates to fine adjustment of radio components and in particular to methods of manufacturing wound items from coaxial microwire and devices therefor.

DESCRIPTION OF THE PRIOR ART

Known in the art is a method of manufacturing wound items representing RC structures from coaxial wire, which essentially consists in alternately unwinding short lengths of wire from the frame of the item being manufactured and measuring parameters of the microwire remaining on said frame. The afore-mentioned operation is performed many times in the case of precision items, a limitation substantially increasing labour requirements in production thereof (cf. "Microwire and Resistance Devices", No. IV, 1969, "Karta Moldovenyaske", Kishinev, I. I. Grishanov, S. N. Dimitraki, Z. I. Zelikovsky "Adjustment of Resistors Made from Insulated Wire", p 250, in Russian). With the foregoing method the adjustment operation accounts for 70 to 80% of the total labour requirements in production of the given item, a factor appreciably reducing the efficiency of labour.

Also known in the art is a method of manufacturing wound items (cf. USSR Inventor's Certificate No. 274, 186, Cl. H01C17/00 published in "Bulletin of Inventions, Industrial Standards, and Trade Marks", No. 21, 1970, in Russian), which essentially consists in winding a specified amount of wire onto the frame of an item being manufactured over a preset length, the resistance of the wire being within 95–98% of the resistance rating for the item. With the aforesaid method the subsequent steps are thermal treatment of the wound wire and measurement of its actual resistance. Thereafter an additional amount of wire is wound on the same frame so as to form an individual winding. The formed windings are then electrically interconnected through a band additionally provided on the frame of the item being manufactured. Such a method of manufacturing wound items calls for the provision of four contacts between the wire and current leads on the frame of the item being manufactured, two of said contacts being connected with the additional band. Increasing the number of wire contacts decreases the reliability of the manufactured item. The foregoing method has been generally unsatisfactory due to the need for individual selection of the adjusting winding for each item, a disadvantage complicating a production procedure, introducing unwanted complexities in soldering wire to a frame band, and, in effect, increasing labour requirements in production of wound items.

The closest prior art reference is a method of manufacturing wound items from coaxial microwire (cf. USSR Inventor's Certificate No. 246,640, Cl. H01C17/00 published in "Bulletin of Inventions, Industrial Standards, and Trade Marks", No. 21, 1969), which essentially consists in unwinding excess microwire from an item being manufactured, which is accompanied by continuous measurements of the electrical parameter of the unwound microwire utilized as an auxiliary item inserted in a measuring circuit, i.e., a bridge along with the item being manufactured. The unwinding operation is stopped at the moment the resistance of the auxiliary item equals the preset resistance of the wire section to be unwound.

While the wire is unwound, a change in the time constant of the item being manufactured due to nonuniformity of the wire linear time constant is accompanied by a variation of the relation between active and reactive components of the time constant of the item being manufactured and the auxiliary item formed by the unwound wire. This variation of the relation between the active and reactive components of the time constant of the manufactured and additional items and continuity of the coaxial sheath of the wire prevent production of like wound items with a practicable accuracy.

Another known device for manufacturing wound items (cf. USSR Inventor's Certificate No. 388,305, Cl. H01C17/00 published in "Bulletin of Inventions, Industrial Standards, and Trade Marks", No. 28, 1973, in Russian) comprises a mechanism for taking up microwire unwound from an item being manufactured, said mechanism having electrical contacts; a mechanism for securing an item being manufactured, said mechanism having a sliding contact; and an electrode providing coupling between microwire and an electrical circuit, said electrode being disposed between the microwire takeup mechanism and the mechanism for securing the item being manufactured.

The aforesaid device also includes a microwire rewind drive kinematically coupled to the microwire takeup mechanism and also to the mechanism for securing the item being manufactured; and a unit for controlling the microwire rewind drive, the output of said unit being connected to said microwire rewind drive.

The known device additionally incorporates an amplifier and converter unit designed to transmit a converted signal conveying information on parameters of an item being manufactured to a microwire rewind control unit whose output is coupled to the input of the drive control unit, a harmonic generator, and a measuring bridge circuit having tight inductive coupling between arms. Continuity of the current-conducting coat of coaxial microwire and nonuniformity of the wire linear parameters determining the microwire time constant do not allow production of wound items from coaxial microwire with a practicable accuracy by the use of the known device.

SUMMARY OF THE INVENTION

The invention resides in providing a method of manufacturing wound items from coaxial microwire and a device therefor, which permit enhancing production accuracy and reliability of items, improving their quality, and simultaneously increasing efficiency of labour in adjusting electrical parameters thereof to a preset rating by unwinding microwire from an item being manufactured without damaging the coaxial sheath, insulation, and conductor of microwire. This procedure is accompanied by continuous monitoring of electrical parameters of unwound wire during an unwinding process with the unwinding operation being stopped as electrical parameters of the unwound microwire reach a predetermined value whereby electrical parameters of the manufactured item will comply with a corresponding rating.

The foregoing object is attained by a method of manufacturing wound items from coaxial microwire comprising the steps of unwinding microwire from an item being manufactured with simultaneous measurements of electrical parameters of the unwound wire, and stopping the microwire unwinding operation as the electrical parameters of the unwound microwire reach a predetermined value. According to the invention, the item being manufactured is inserted in a measuring circuit and determination is made of the voltage frequency $f_1$ at which a phase shift between current vector in a coaxial sheath of microwire of the manufactured item whose electrical parameter exceeds a corresponding rating and voltage vector between the coaxial sheath and conductor of said microwire equals 180°. The next step consists in setting the voltage frequency $f_2$ at which a phase shift between current vector in the coaxial sheath of microwire of the manufactured item whose electrical parameter fully complies with the rating and voltage vector between the coaxial sheath and conductor of said microwire is 180°. Thereafter the voltage frequencies $f_1$ and $f_2$ are converted into voltage frequency $f_x$, where $$f_x = \frac{f_2 \cdot f_1}{f_2 - f_1}$$

The voltage at $f_x$ is then fed to the coaxial sheath of the microwire of the item being manufactured whereupon the microwire is unwound. This entails the process of continuously comparing a current vector phase in the coaxial sheath of the unwound wire with a voltage vector phase between the conductor of said microwire and its coaxial sheath. The microwire is unwound from the item being manufactured until the electrical parameter of said item reaches a preset rating, which corresponds to a 180° difference in the compared phases of the unwound microwire.

The voltage at $f_x$ may be fed simultaneously and continuously to the start of the conductor and the sheath of the microwire of the item being manufactured.

The foregoing object is also accomplished by a device for manufacturing wound items from coaxial microwire comprising a takeup mechanism for taking up microwire unwound from an item being manufactured and having electrical contacts; a securing mechanism for securing the item being manufactured and having a sliding contact; an electrode providing coupling between the microwire and an electrical circuit and disposed between the microwire takeup mechanism and the mechanism for securing the item being manufactured; a microwire rewind drive kinematically coupled to the microwire takeup mechanism and to the mechanism for securing the item being manufactured; a unit, for controlling the microwire rewind drive; having an output connected to the microwire rewind drive, an amplifier and converter unit designed to transmit a converted signal conveying information on parameters of the item being manufactured to the microwire rewind drive control unit whose output is connected to the input of the drive control unit; a harmonic generator; an additional harmonic generator; a switch with sets of contacts; and a frequency changer whose input is connected to the potential output of the additional harmonic generator whose second input is connected to the potential output of the harmonic generator through one fixed contact and the moving contact of the first contact set, the moving contact of the first contact set being connected to one of the fixed contacts of the second contact set of the switch, while the moving contact of the second contact set is connected to the first electrical contact of the microwire takeup mechanism having galvanic coupling with one of the ends of the conductor of the microwire of the item being manufactured. The output of the frequency changer is coupled to one of the fixed contacts of the third contact set of the switch, the moving contact of said contact set being connected to the sliding contact of the mechanism for securing the item being manufactured, while the second fixed contact of the third contact set of the switch is connected to the potential input of an indicator. The device in accordance with the invention also includes a resistance box, one pole of which is connected to the moving contact of the fourth contact set of the switch, one of the fixed contacts of said contact set being connected to a flexible current lead of the item being manufactured; and a current-to-voltage converter having its potential input connected to the second electrical contact of the microwire takeup mechanism and its output coupled to one of similar inputs of the amplifier and converter unit whose second input is connected to the second fixed contact of the second contact set of the switch. The second input of the indicator, the second output of the additional harmonic generator, the second pole of the resistance box, the case of the frequency changer, the second input of the current-to-voltage converter, the second output of the harmonic generator and the electrode are connected to a neutral wire of the device.

The device forming the subject of the present invention may advantageously include a fifth contact set of the switch whose moving contact is connected to the moving contact of the third contact set of the switch, the fixed contact of the fifth contact set being connected to the flexible current lead of the item being manufactured.

The invention permits increasing efficiency of labour by 5–6 times and enhancing reliability and quality of manufactured items by 1.5–2 times. Furthermore, less effort is required on the part of a workman and his eyes do not get tired too soon. Another advantage is the possibility of employing relatively unskilled operatives.

BRIEF DESCRIPTION OF THE DRAWINGS

The invention will now be described further with reference to specific embodiments thereof, taken in conjunction with the accompanying drawings, wherein:

FIG. 1 is a diagram illustrating an equivalent circuit for determining frequency $f_1$ according to the invention;

FIG. 2 is a diagram illustrating an equivalent circuit for determining a difference between a current vector phase in a coaxial sheath of unwound wire and a voltage vector phase between the conductor of said microwire and its coaxial sheath according to the invention.

DETAILED DESCRIPTION OF THE INVENTION

Figure 3:
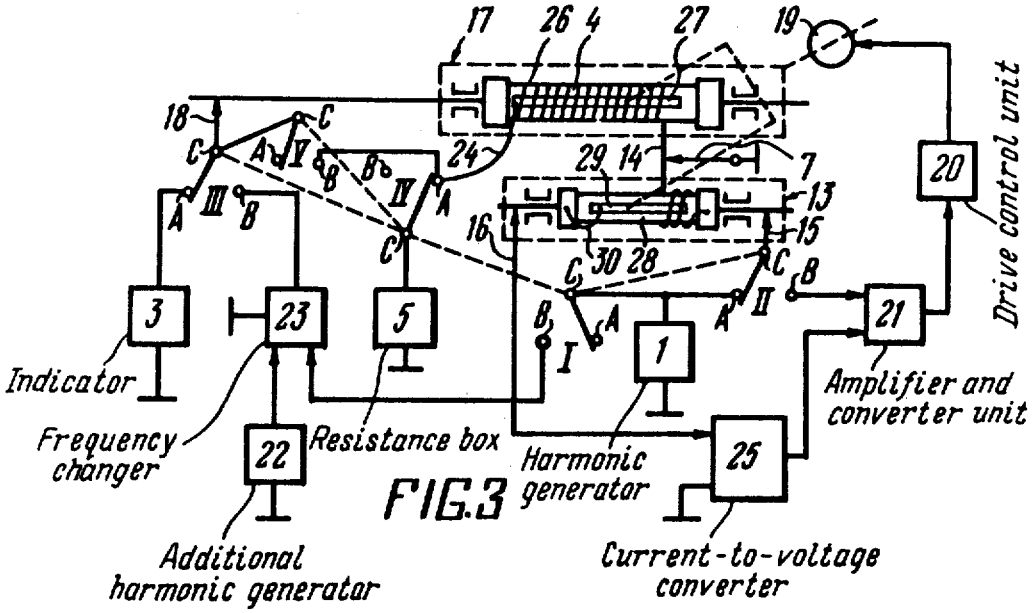
FIG. 3 is a block diagram of a device for manufacturing wound items from coaxial microwire according to the invention.

It is known that the product of the time constant T of a phase-shifting RC network of a zero filter and voltage frequency f is a constant value equal to 1.78 when the transmission coefficient of said filter is zero (cf. Foreign Radio Electronics, No. 4, 1963 (USA), Kayzer, Castro, Nichols "Thin-film Circuits with Distributed Constants"). At the frequency f a phase shift between current in the zero-resistance layer, for example, a short-circuited wire sheath of the item, and voltage present between said layer and a resistive layer equals 180°, i.e.

$$T \cdot f = 1 \cdot 78 = \text{const} \quad (1)$$

Referring to (1) above we can write $$T_2 \cdot f_2 = T_1 \cdot f_1 = \Delta T \cdot f_X = 1.78,$$

where $T_2$ = time constant of a wound item whose electrical parameter fully complies with a corresponding rating; $f_2$ = voltage frequency at which a phase shift between current in the coaxial sheath of microwire and voltage present between said sheath and conductor equals 180°; $T_1$ = time constant of the manufactured item whose electrical parameter exceeds the rating; $f_1$ = voltage frequency at which a phase shift between current vector in the coaxial sheath of microwire of the item being manufactured and voltage present between said sheath and conductor is 180°; and $\Delta T$ and $f_X$ = similar quantities characterizing the microwire to be removed from the item being manufactured.

Transforming the product $T_1 \cdot f_1$ we obtain $$T_1 \cdot f_1 = (T_2 + \Delta T)(f_2 - \Delta f) = T_2 \cdot f_2 + \Delta T \cdot f_2 - T_2 \cdot \Delta f - \Delta T \cdot \Delta f = 1.78 \quad (2)$$

Using equation $T_2 \cdot f_2 - 1.78 = 0$ we may express formula (2) as $$\Delta T \cdot f_2 - T_2 \cdot \Delta f - \Delta T \cdot \Delta f = 0$$

Hence, $$\Delta T = T_2 \frac{\Delta f}{f_2 - \Delta f}$$

Multiplying the right and left parts of the above equation by $f_X$ yields $$\Delta T \cdot f_X = T_2 \frac{\Delta f \cdot f_X}{f_2 - \Delta f} = 1.78 \quad (3)$$

Thus, $$f_X = 1.78 \frac{f_2 - \Delta f}{f_2 \cdot \Delta f} = \frac{1.78}{T_2 \cdot f_2} \cdot \frac{f_2(f_2 - \Delta f)}{\Delta f} = \frac{f_2[f_2 - (f_2 - f_1)]}{f_2 - f_1} = \frac{f_2 \cdot f_1}{f_2 - f_1},$$

where $f_X$ = voltage frequency used, during a microwire unwinding operation for continuous monitoring of a phase shift between current vector in the coaxial sheath of the unwound microwire and voltage vector between said sheath and the end of the conductor of said microwire, the unwinding operation being stopped as said phase shift equals 180°.

Thus, in compliance with the method forming the subject of the present invention relative production error $\delta_1$ is determined by relative error $\delta_2$ in measuring the quantity $\Delta T$ and also by relative error $\delta_3$ of the manufactured item, as regards its electrical parameter after thermal treatment prior to an unwinding operation, said errors being interconnected by the following relationship:

$$\delta_1 = \delta_3 \cdot \delta_2 = \frac{\Delta T}{T_2} \cdot \frac{\Delta(\Delta T)}{\Delta T} = \frac{\Delta(\Delta T)}{T_2}, \quad (4)$$

where $\Delta(\Delta T)$ = absolute measuring error.

For example, at $\delta_2 = 1\%$ and $\delta_3 = 3\%$ (worst case) $\delta_1 = 0.03\%$.

The equivalent circuits of FIGS. 1 and 2 enable a clearer understanding of the hereinproposed method of manufacturing wound items from coaxial microwire.

The equivalent circuit of FIG. 1 includes a harmonic generator 1, a hybrid rejection filter 2, and an indicator 3.

In the preferred embodiment of the invention the electrical circuit containing a manufactured item represents the rejection filter 2 formed by an item 4 being manufactured and resistance $R_N$ of a resistance box 5.

The equivalent circuit of FIG. 2 is used for determining a phase difference between current in the sheath of unwound microwire and voltage present between the conductor of said microwire and its sheath. Said circuit includes sources 6 furnishing voltage at frequency $f_X$, an electrode 7 providing coupling between the microwire and the electrical circuit, namely the case of the device, and a section 8 of the microwire unwound from the item 4 being manufactured. The section 8 is formed with a length 9 of the microwire whose parameters are being continuously checked, and a length 10 of the microwire. A drop of voltage at $f_X$ is produced across resistance $R_X$ of the coaxial sheath of the length 10 of the microwire, said drop being subsequently used as a measuring signal. Resistance $R_{NX}$ of a portion of the sheath of the length 9 of the microwire is used to set the current whose phase is compared with the phase of the voltage between a conductor 11 and a sheath 12 of the microwire length 9.

$R_1$ is the resistance of the conductor of the length 10 of the microwire forming capacitance $C_{1-X}$ in conjunction with its coaxial sheath.

$R_2$ is the resistance of a portion of the conductor 11 of the microwire length 9 whose coaxial-sheath resistance is equal to the resistance $R_{NX}$. Said portion of the conductor with its coaxial sheath forms capacitance $C_{2-NX}$.

$R_3$ is the resistance of the remaining portion of the conductor 11 of the microwire length 9 whose coaxial sheath is short-circuited, which provides zero resistance of the sheath of said length of the wire. Said portion of the conductor with its short-circuited sheath forms capacitance $C_3$.

The section of the conductor 11 of the microwire on the item 4 being manufactured has resistance $R_o$ and forms capacitance $C_o$ in conjunction with its sheath.

FIG. 3 is a block diagram of a device for manufacturing wound items from coaxial microwire in compliance with the hereinproposed method. Referring to the drawing the device comprises a take up mechanism 13 for taking up a microwire 14 unwound from the item 4 being manufactured and having electrical contacts 15 and 16; a securing mechanism 17 for securing the item being manufactured and having a sliding contact 18; an electrode 7 providing coupling between the microwire 14 and the electrical circuit, said electrode being disposed between the take up and securing mechanisms 13 and 17; and a microwire rewind drive 19 kinematically coupled to the take up and securing mechanisms 13 and 17.

The device according to the invention also includes a control unit 20 for controlling the microwire rewind drive and having an output connected to the microwire rewind drive 19; an amplifier and converter unit 21 designed to transmit a converted signal conveying information on parameters of the item being manufactured to the control unit 20, the output of the amplifier and converter unit 21 being connected to the input of the drive control unit 20; the harmonic generator 1; an additional harmonic generator 22; a switch with contact sets I, II, III and IV; and a frequency changer 23 whose first input is connected to the output of the additional harmonic generator 22 and whose second input is connected to fixed contact B of contact set I of the switch. Moving contact C of said contact set is combined with fixed contact A of contact set II of the switch and coupled to the potential output of the harmonic generator 1. Moving contact C of contact set II of the switch is connected to the electrical contact 15 of the take up mechanism 13 having galvanic coupling with one of the ends of the conductor of the microwire 14 of the item 4 being manufactured. The output of the frequency changer 23 is connected to fixed contact B of contact set III of the switch whose moving contact C is connected to the sliding contact 18 of the mechanism 17, while the fixed contact A thereof is connected to the potential input of the indicator 3.

The device according to the invention additionally incorporates the resistance box 5 used to set the resistance $R_N$(FIG. 1) as the rejection filter 2 is formed. One of the poles of the resistance box 5 is connected to moving contact C of contact set IV of the switch, while fixed contact A of contact set IV of the switch is connected to a flexible current lead 24 of the frame of the manufactured item 4.

Besides, the device in compliance with the invention comprises a current-to-voltage converter 25 whose potential input is connected to the electrical contact 16 of the take up mechanism 13, the output of the converter 25 being connected to one of similar inputs of the amplifier and converter unit 21. The second input of the amplifier and converter 21 is connected to fixed contact B of contact set II of the switch. The second input of the indicator 3, the second output of the additional generator 22, the second pole of the resistance box 5, the case of the frequency changer 23, the second input of the current-to-voltage converter 25, the second output of the generator 1, and the electrode 7 are connected to a neutral wire of the device.

The item 4 being manufactured includes a frame 26 topped with a current-conducting layer 27, said frame being connected to the flexible current lead 24.

The microwire 14 should be unwound into a current-conducting medium. In the preferred embodiment of the invention the microwire 14 is unwound onto a frame 28 with a current-conducting coat 29, which is electrically coupled to a flexible lead 30.

The device forming the subject of the present invention also contains contact set V of the switch whose moving contact C is connected to the moving contact C of contact set III, while fixed contact B of contact set V is connected to the fixed contact A of contact set IV of the switch.

The device for manufacturing wound items from coaxial wire in compliance with the invention operates as follows.

The end of the microwire 14 is cut from the current lead of the frame 26 having no electrical coupling with the sliding contact 18. This end is stripped of the coaxial coat and electrically terminated in the current lead of the frame 28 having electrical coupling with the contact 15.

In determining the frequency $f_1$ the moving contacts of contact sets, I, II, III, IV, and V of the switch are connected to the respective fixed contacts A of the same contacts sets. The generator frequency and the resistance $R_N$ (FIG. 1) set by the use of the resistance box 5 are slowly varied until a zero difference is obtained between voltage $U_N$ decreasing across $R_N$ and voltage $U_M$ present between the conductor and the coaxial sheath of the microwire 14 (FIG. 3) whose other end is connected to the current lead of the manufactured item 4 electrically coupled to the indicator 3 through the sliding contact 18, the moving contact C of contact set III, and its fixed contact A. A zero difference between the voltages $U_N$ (FIG. 1) and $U_M$ indicates that said voltages have equal modules but opposite phases. The frequency of the generator 1 corresponding to the zero difference $U_N - U_M$ is the rejection frequency of the formed rejection filter 2, its value being equal to $f_1$. The time constant $T_1$ of the item 4 being manufactured will then be $$T_1 = \frac{1 \cdot 78}{f_1} \tag{5}$$

The frequency $f_1$ of the generator 1 corresponds to zero transmission coefficient of the formed rejection filter 2, the electrical parameter ($T_1$) of the manufactured item exceeding the corresponding rating by $\Delta T$.

After the frequency $f_1$ has been determined, the moving contacts C (FIG. 3) of contact sets I, II, III, IV, and V of the switch are connected to the respective fixed contacts B of the same contact sets, the voltage of the generator 1 at the frequency $f_1$ and the voltage of the additional generator 22 at the assigned frequency $f_2$ being applied to the frequency changer 23 wherein they are converted into a voltage at the frequency $$f_X = \frac{f_2 \cdot f_1}{f_2 - f_1}$$

The frequency $f_2$ is chosen from the equation $$f_2 = \frac{1 \cdot 78}{T_2},$$

where $T_2$=time constant of the manufactured item 4 whose electrical parameter fully complies with the corresponding rating.

The voltage at the frequency $f_X$ is applied from the frequency changer 23 through the fixed contact B, the moving contact C of contact set III of the switch, and the sliding contact 18 to the current lead of the manufactured item 4 having galvanic coupling with the conductor of the microwire 14 and with the flexible current lead 24 by way of the moving contact C and the fixed contact B of contact set V of the switch.

Such a connection results in the voltage of the frequency $f_X$ is applied to the sheath of the length 10 (FIG. 2) of the microwire having the resistance $R_X$.

Simultaneously the microwire rewind drive 19 (FIG. 3) is started, and the microwire 14 is wound from the item 4 being manufactured onto the frame 28. During the rewinding operation, the microwire 14 slides over the electrode 7.

The voltage decreasing across the resistance $R_X$ (FIG. 2) of the coaxial sheath is fed through the equivalent resistance of the microwire remaining on the item 4 and the resistance $R_1$ to the input of the item formed by the length 9 (FIG. 2) of the microwire wound on the frame 28 (FIG. 3), i.e. said voltage is applied to points M and K. The time constant of the length 9 of the microwire is equal to $\Delta T$.

Depending on the value of the length 9 of the microwire wound on the frame 28 (FIG. 3), a phase difference between the vector of current in the sheath of said microwire converted by the converter 25 into voltage and the voltage vector between the conductor 11 (FIG. 2) and the coaxial sheath 12 of the length 9 of the microwire will change. When the time constant of the length 9 of the microwire reaches the predetermined value $\Delta T$, said phase difference will be equal to 180° at the frequency $f_X$. Thus, $$f_X \cdot \Delta T = 1.78$$

While the microwire 14 (FIG. 3) is unwound without any damage done to its sheath, insulation or conductor, said phase difference is being continuously monitored by the amplifier and converter unit 21 which controls the drive 19. As said phase difference reaches 180°, the amplifier and converter unit 21 disconnects the drive 19 through the unit 20, and the unwinding of the microwire 14 is stopped. The electrical parameter of the manufactured item 4 will then fully conform to the corresponding rating.

The connection between the start of the conductor of the microwire 14 and the coaxial sheath of the microwire 14 through contact set V of the switch makes it possible to maintain the sensitivity of the device, as regards the parameter being measured, irrespective of the amount of the microwire 14 of the manufactured item 4.

The hereinproposed method and the device therefor enable continuous production of wound items from coaxial microwire without any damage done to the coaxial sheath, insulation or conductor of the microwire 14. Furthermore, the output of quality wound items has increased from 15 to 100%, another advantage being a simultaneous efficiency increase by some 5 or 6 times.

Industrial Use

The invention may be used to advantage in precision instrument making, radio electronics and computer technology for production of phase-shifting elements and components of selection circuits.

We claim:

1. A method of manufacturing wound items from coaxial microwire comprising the steps of unwinding microwire from an item being manufactured with continuous measurements of an electrical parameter of the unwound wire; stopping the microwire unwinding process as the electrical parameter of the unwound wire reaches a predetermined value; inserting said item being manufactured in an electrical circuit including a voltage source determining a voltage frequency $f_1$ at which a phase shift between a current vector in a coaxial sheath of a microwire of the item being manufactured whose electrical parameter exceeds the rating and voltage vector between the coaxial sheath and conductor of the microwire equals 180°; setting voltage frequency $f_2$ at which a phase shift between the current vector in the coaxial sheath of the microwire of the item being manufactured whose electrical parameter fully complies with the corresponding rating and the voltage vector between the coaxial sheath and conductor of the microwire is 180°; converting voltages at the frequencies $f_1$ and $f_2$ into voltage at the frequency $f_X$, where $$f_X = \frac{f_2 \cdot f_1}{f_2 - f_1};$$

applying the voltage at the frequency $f_X$ to the coaxial sheath of the microwire of the item being manufactured; and again unwinding the microwire with the current vector phase in the coaxial sheath of the unwound wire being continuously compared with the voltage vector phase between the conductor of said microwire and its coaxial sheath, the unwinding of the microwire from the item being manufactured being continued until the electrical parameter of the item being manufactured reaches the preset rating, a condition corresponding to a 180° difference between the compared phases in the unwound wire.

2. A method as claimed in claim 1 further comprising feeding simultaneously and continuously the voltage at the frequency $f_X$ to the start of the conductor and the sheath of the microwire of the item being manufactured.

3. A device for manufacturing wound items from coaxial microwire comprising a take up mechanism taking up wire unwound from an item being manufactured and having electrical contacts; a securing mechanism securing the item being manufactured and having a sliding contact; an electrode providing coupling between the microwire and an electrical circuit and disposed between the microwire take up mechanism and the securing mechanism; a microwire rewind drive kinematically coupled to the microwire take up mechanism and to the securing mechanism; a control unit controlling the microwire rewind drive and having an output connected to the microwire rewind drive; an amplifier and converter unit transmitting a converted signal conveying information on parameters of the item being manufactured to the microwire rewind drive control unit; a first harmonic generator; a second harmonic generator; a switch with first, second, third and fourth contact sets; a frequency changer having a first input connected to a potential output of the second harmonic generator and a second input coupled to a potential output of the first harmonic generator through a second fixed contact and a moving contact of the first contact set of the switch; wherein the moving contact of the first contact set of the switch is connected to a first fixed contact of the second contact set of the switch, a moving contact of the second contact set of the switch is connected to an electrical contact of said takeup mechanism having galvanic coupling with one of the ends of the conductor of the microwire of the item being manufactured, an output of the frequency changer is connected to a second fixed contact of the third contact set of the switch, a moving contact of the third contact set is connected to the sliding contact of the securing mechanism; further comprising an indicator having a potential input connected to a first fixed contact of the third contact set of the switch; a resistance box having a first pole connected to a moving contact of the fourth contact set of the switch being connected to a flexible current lead of the item being manufactured; a current-to-voltage converter having a potential input connected to an electrical contact of the microwire takeup mechanism; an amplifier and converter unit having inputs connected to an output of said current-to-voltage converter, and a second input connected to a second fixed contact of the second contact set of the switch; wherein a second input of the indicator, a second output of the second harmonic generator, a second pole of the resistance box, a case of the frequency changer, a second input of the current-to-voltage converter, a second output of the first generator, and an electrode are connected to a neutral wire of the device.

4. A device is claimed in claim 3, further comprises a fifth contact set of the switch having a moving contact connected to the moving contact of the third contact set of the switch, and a fixed contact connected to the flexible lead of the item being manufactured.

* * * * *